169-47 SR
1/1/80 OR 4,181,179

United States Patent [19]
Batte

[11] 4,181,179
[45] Jan. 1, 1980

[54] AIRPORT RUNWAY FIRE CONTROL METHOD AND APPARATUS

[76] Inventor: Christopher L. Batte, 7816 Purdue, Dallas, Tex. 75225

[21] Appl. No.: 885,534

[22] Filed: Mar. 13, 1978

[51] Int. Cl.[2] ..... A62C 37/04
[52] U.S. Cl. ..... 169/47; 169/61; 169/62; 169/16; 244/114 R
[58] Field of Search ..... 169/54, 56, 60–62, 169/70, 46, 47, 16; 239/200, 207; 244/114 R

[56] References Cited

U.S. PATENT DOCUMENTS 3,063,502 11/1962 Lakind ..... 169/54
3,583,637 6/1971 Miscovich ..... 244/114 R X

*Primary Examiner*—Charles A. Marmor
*Attorney, Agent, or Firm*—Crisman & Moore

[57] ABSTRACT

A method and apparatus for instantaneous response and control of an aircraft and/or airfield fire. An array of fire retardant nozzles interconnected to a fire retardant supply system is provided alongside a runway of an airport and interconnected with a computerized control network for remote actuation thereof. A series of different types of sensors is provided in conjunction with the retardant nozzle system for detecting heat of the type produced from an aircraft and/or runway fire or incident and permitting fire retardant response thereto. The sensors are constructed in conjunction with orientation and angulation drive systems for positioning the separate fire-retardant nozzles in a configuration for spraying fire retardant upon the selected combustion. The system is provided with a smoke and fume evacuation system for use in conjunction therewith whereby toxic by-products of aircraft fire may be removed from the vicinity of the fire hazard. In the same manner, a laser integrated glide path response system is provided for use in conjunction with the computerized network for activation in times of detected emergency. In this manner, the response time to an aircraft fire may be substantially reduced and the deleterious side effects thereof eliminated because of the prompt utilization of the present invention.

12 Claims, 3 Drawing Figures

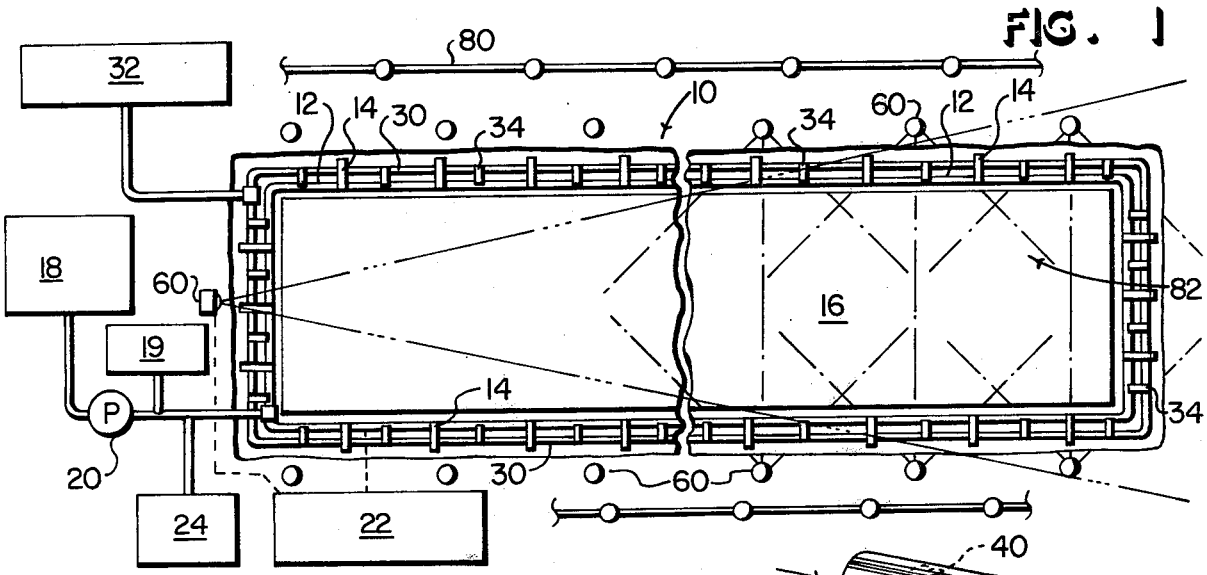
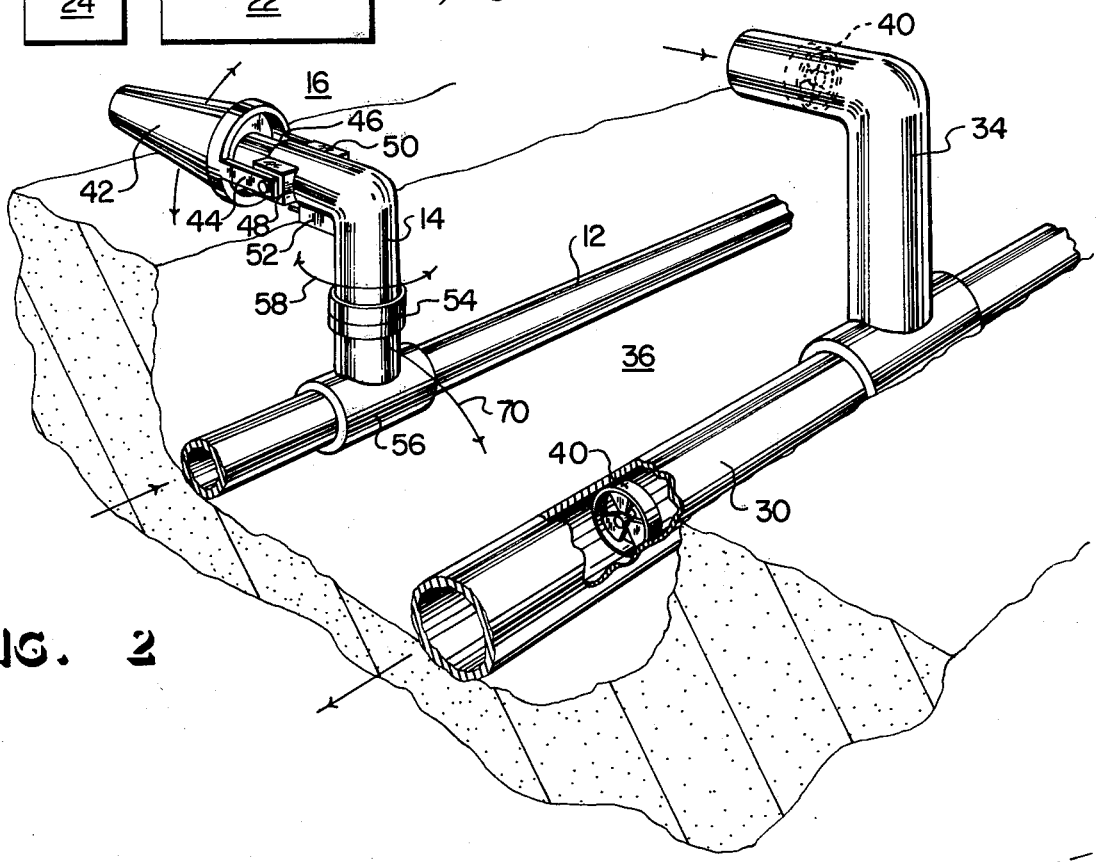
FIG. 2
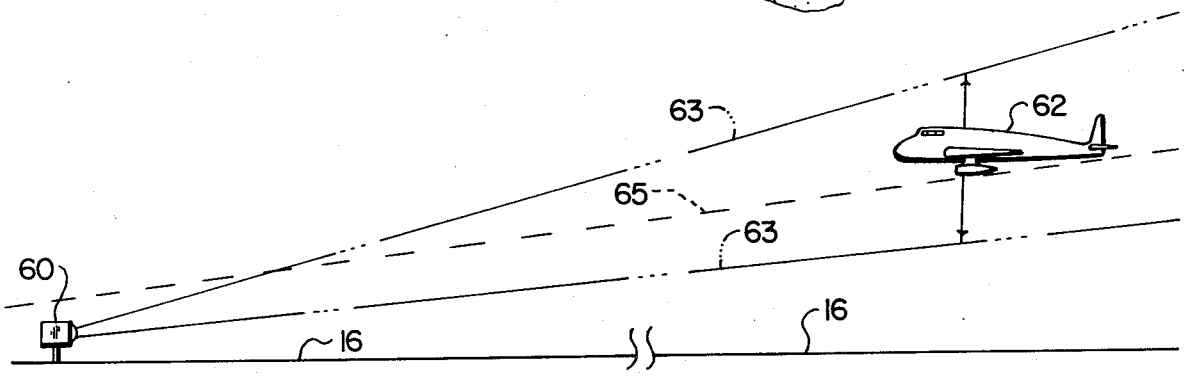
FIG. 3

AIRPORT RUNWAY FIRE CONTROL METHOD AND APPARATUS

BACKGROUND OF THE INVENTION

The invention relates to fire control devices and, more particularly, to a system of fire retardant nozzles in communication with a computerized control network for remote actuation and control of aircraft and/or airfield fires.

The conventional method of fighting and supressing aircraft fire is to wait alongside a runway until the aircraft stops its forward movement. At that point, fire fighting equipment is rushed to the aircraft for extinguishing the combustion while extracting survivors from the wreckage. This conventional method is inefficient from the standpoint of delay time between detection of the fire and provision of suitable fire retardant materials thereon. Very often the location of the fire is very far from the fire retardant supply, necessitating both costly and inefficient equipment and operative tecniques therebetween. Moreover, the genesis of combustion often occurs during the descent and/or touchdown of aircraft on runways further increasing the delay time between the point of combustion and response thereto.

It would be an advantage therefore to overcome certain of the problems and inconveniences and hazards of prior art apparatus and methods by providing an improved fire control system which can be incorporated directly in conjunction with an airport runway. The fire control system of the present invention is especially adapted for use in conjunction with commercial runways and for accomodating any combustion occurring in the vicinity of the runway and efficiently combating the combustion with a response time heretofore unfeasible. In this manner, the magnitude of property damage and the seriousness of personal injury may be substantially reduced.

SUMMARY OF THE INVENTION

The invention relates to methods and apparatus for use in conjunction with fire control systems and the combating of fires. The apparatus includes an array or arrays of spray nozzles interconnected with networks of supply piping buried alongside the airport runway for activation in response to computer command signals. The networks of supply piping include heat sensors constructed in conjunction with the spray nozzles for controlling angulation and orientation thereof for maximum coverage of combustion occurring within the spray area of the nozzles. Water and/or fire suppressant material in combination therewith is supplied in the networks of supply piping from a reservoir at one end of the runway and maintained in a constant pressure configuration for immediate response to a combustion signal.

In another aspect of the invention there is provided a second network of exhaust piping having an array of exhaust intake ports provided therewith. The intake ports may be activated in response to the combustion signal for receiving a forced air draft of the vapor products of a fire occurring in the vicinity thereof. In this manner toxic fumes may be eliminated immediately without resort to natural diffusion in the atmosphere which normally takes a greater time and endangers personnel in the vicinity. The activation of both the exhaust stacks and the spray nozzles is facilitated through interaction with a computer system tied into said networks. The actual angulation and orientation of said exhaust stacks and spray nozzles is effected through a series of small actuation motors supplied in conjunction with said nozzles.

In yet another aspect of the invention, the spray nozzles are stored in a down position beneath the ground level and activated to a standing position through a spring or similar biasing element responsive to computer command. Orientation of each individual nozzle may be facilitated through the utilization of independent heat sensors tied to small drive linkages interconnected with the nozzle pipe for directing the nozzle to the combustion in individual response modes.

In one further aspect of the invention, a laser beam response system is incorporated into the fire control system for establishing a controlled glide path for aircraft approaching the control runway. The zone established by the laser beam provides a method of inputting possible impending combustion due to failure of the aircraft to maintain its predefined stable glide pattern. In instances where loss of aircraft control and/or in-air combustion occurs the aforesaid laser system may activate the fire control system through an alarm network resonsive to said deviations from landing norms. In this manner, communication between the aircraft pilot and the ground control or computer is unnecessary in that the system responds to aircraft speed and directional configuration during the approach pattern.

BRIEF DESCRIPTION OF THE DRAWINGS

For a more complete understanding of the present invention and for further objects and advantages thereof, reference may now be had to the following description taken in conjunction with the accompanying drawings in which:

FIG. 1 is a top plan diagrammatical view of a fire control system and method thereof constructed in accordance with the principles of the present invention;

FIG. 2 is an enlarged fragmentary view of a spray system and exhaust system of the type diagrammatically represented in FIG. 1, shown in side-by-side relationship alongside an airport runway for fire control thereupon; and FIG. 3 is a side elevational, diagrammatical view of a glide path control system of the type shown in FIG. 1 for detecting deviations from the norm of aircraft approach and selectively initiating response by the fire control system.

DETAILED DESCRIPTION

Referring first to FIG. 1, there is shown a top plan diagrammatical view of a fire control system for instantaneously detecting and controlling an aircraft or airfield fire. A fire control system 10 includes a network 12 of fire supressant including a plurality of sray nozzles 14 spaced sequentially therealong generally circumferentially about an airport runway 16, as shown. The supply network 12 is constructed for containing water and/or fire suppressant under pressure in sealed communication with a reservoir 18 disposed adjacent the runway 16. A pump system 20 is incorporated in line therewith in conjunction with an air pressure reservoir 19 for maintaining the necessary pressure relationship within the system 12, while the water pumps are building up pressure to push the water along. Activation of the fire suppressant system is maintained in response to a computer network 22 connected therewith. In this manner, any combustion occurring in the vicinity of the runway 16 may be immediately dealt with through the reaction of the fire suppressant nozzle network 12.

Still referring to FIG. 1 there is shown a reservoir 24 for containing $CO_2$ and/or other fire suppressant chemical for infusion into the supply line of network 12 and subsequent spray through the nozzles 14 onto the subject combustion. The gaseous by-products of the combustion occurring on the runway may also pose a serious personnel hazard. Therefore, an exhaust network 30 is incorporated about the periphery of the runway 16 in conjunction with the fire suppressant supply network 12 for exhausting toxic fumes. The exhaust network 30 is interconnected to an exhaust gas reservoir 32 provided in sealed communication therewith for receiving the gases inhaled by a plurality of exhausting ports 34 spaced around the runway 16, as shown.

Referring now to FIG. 2 there is shown an enlarged fragmentary respective view of a fire suppressant supply line 12 and exhaust system 30 in side-by-side relationship and in position for combating fire upon the runway 16. The systems 12 and 30 are provided within a trench 36 constructed alongside the runway 16 for concealing and protecting the aforesaid systems during times of nonuse. when the systems are activated the exhaust ports 34 and fire suppressant nozzles 14 move into the upright position to upstand from the supply lines and project upwardly from the trench. In the position shown in FIG. 2 the exhaust port 34 faces the area immediately before the exhaust fan for evacuating toxic fumes from therearound. The spacing of exhaust ports 34 about the runway is designed to facilitate an evacuation rate acceptable for hazard conditions. Similarly, the position of the fire retardant nozzles 14 is designed such that said nozzles are spaced within range of one another for combating any combustion occurring distant any point therebetween for paired coverage thereby.

As shown in FIG. 2 the evacuation system 30 includes a series of fans or blowers 40 spaced therealong for driving the exhaust gases through the system and causing the drawing or ingressing of the gases from the runway into the ports 34. In like manner, the reservoir 32 includes an evacuation system and filter network for lowering the pressure therein to receive the exhaust fumes from the system 30.

Still referring to FIG. 2 it may be seen that the nozzle 14 includes a flow orientation and concentration cone 42 which is mounted upon side frame arms 44 and 46 to the hinge element 48 and 50 of the nozzle 14. The hinge elements 48 and 50 are constructed for remote actuation through conventional drive means (not shown) constructed therein and interconnected therewith the computer system 22 and a remote sensor 52 constructed therebeneath. The sensor 52 is preferably of the heat actuatable variety of conventional design and is interconnected with drive means 54 constructed between the nozzle 14 and a support T conduit 56 therebeneath interconnecting said nozzle to the supply system 12. The drive system 54 includes a remotely actuatable conventional motor means (not shown) for rotation of the nozzle 14 in the direction of the arrow 58 as shown for lateral deflection of the spray of fire suppressant therefrom. The elevation of the fire suppressant is controllable through the hinge means 48 and 50 deflecting the cone 42 to the select orientation. Command signals for said orientation and elevation drive are selectively programmed through the computer 22 via the sensor 52 provided adjacent thereto wherein the sensor is preferably programmed by the computer 22 for angulation and orientation toward the highest energy input. In this manner, the sensor will always address the combustion area across the bi-axial network and in which configuration the nozzles will likewise assume the select configuration for spraying fire suppressant upon the combustion.

Referring now to FIG. 3 there is shown a runway 16 with a glide path detector 60 disposed about the end thereof for defining a preselected glide path pattern and signaling any aircraft deviation therefrom. As shown in FIG. 3 an aircraft 62 is approaching the runway 16 within a glide path shown by phantom lines 63 in a manner so that the detector 60 remains in a neutral signal mode. Should the aircraft 62 leave a preselected glide path or mode established by the computer 22 and shown by phantom lines 65, the detector 60 would signal the computer network 22 for activation of the fire suppressant networks 12 and 30. Should an emergency condition arise the systems are ready to immediately respond. In this manner, it is not necessary for any human effort to alert the fire suppressant system thus alleviating the possibility of human error and reaction time.

In operation, the computerized system 22 is interconnected with the control tower for both manual and automatic reaction to any aircraft and/or airport condition. As an aircraft approaches the runway 16 the tower may be in manual command for alerting the systems 12 and 30 should a hazard be detected. The computerized systems serve as a backup to alleviate all human error. Should the hazard occur in the vicinity of the runway within the scope of the detector 60 preferably of a laser, electric eye and/or other conventional pattern defining network, the system 22 may automatically react to prepare the runway 16 for a hazard such as combustion. The detector 60 may also signal the computer as to the exact location of the craft on the runway for select activation of the nearest nozzles 14 of the network. Moreover, the computerized "awareness" of aircraft location on the runways, via the various detecters 60, facilitates ground control efforts in channeling traffic as well as combating fire. In such a reaction mode, the spray nozzles 14 are oriented upwardly from the trench 36 in the direction of the arrow 70. In the upright position the nozzles remain ready for orientation and angulation toward the area of combustion once detected by the sensors 52, and/or the detection system 60. In like manner, the exhaust system 30 is brought into an upright configuration from the trench 36 with the exhaust ports 34 facing the runway for subsequent activation of the blowers 40 after combustion has been brought to rest, so as to not "fan" the fire with forced air currents. Activation of the blowers 40 may be facilitated through the computerized network 22 and/or the sensor actuation of sensors 52. In this manner, the sensor 52 not only functions as orientation apparatus for the nozzles 14 but facilitates alarm in actuation detection of any combustion occurring in the vicinity thereof for complete plotting and control thereof in the control tower. Similarly, in an alternative embodiment, the exhaust ports 34 may be selectively opened and closed for intaking gases only from the vicinity of the sensors which are within a predefined range of the combustion. In this manner, an evacuation of non-toxified air distant from the combustion may be prevented and a more highly concentrated effectiveness for the exhaust evacuation system 30 is effected.

It may be seen that the system of the present invention may not only eliminate the normal delay time for responding to combustion and/or foaming runways during times of emergency and similar hazards on the runway, but could be effective in saving lives and preventing extensive damage to aircraft in which combustion can be retarded or even prevented by such a short response time. Moreover, in various alternative embodiments system modifications can be provided which virtually obsolete conventional fire fighting equipment. For example, an outer network 80 of fire suppressant piping may be provided outwardly of the inner system 12. Airplanes which miss the runway 16 or otherwise move out of the runway vicinity could then be handled with equal ease. Such a "backup" system 80 could also service two parallel runways. The actuation of such a system 80 would preferably be in response to a craft leaving the detector grid pattern 82 set up on the runway 16 by the detector system 60. It may thus be seen that the elements of the present invention are tied one with the other to interact into a "fail safe" operational mode for serving any number of runways or runway configurations.

It is believed that the operation and construction of the above described invention will be apparent from the foregoing description. While the method and apparatus for airport fire control shown and described have been characterized as being preferred, it will be obvious that various changes and modifications will be made without departing from the spirit and scope of the invention as defined in the following claims.

I claim:

1. An airport fire control system for combating combustion in the vicinity of an airport runway, said system comprising:

a network of tubing containing a fire suppressant substance and disposed about said airport runway;

means for pressurizing said fire suppressant substance within said tubing and causing said fire suppressant substance to egress under relatively constant pressure;

discharge means spaced along said tubing and interconnected therewith for discharging fire suppressant material therefrom;

angulation means coupled to said discharge means controlling the orientation of said discharge means for selectively ejecting fire suppressant in a predefined pattern;

control means for regulating the actuation of said network of tubing;

detector means interconnected with said control means for sensing a select event requiring the discharge of fire suppressant from said discharge means;

said detector means including a heat sensor coupled to said discharge means for causing the select angulation thereof for spraying fire suppressant upon a select area; and said control means including detector means coupled therewith for establishing a select glide path spectrum and receiving a response therefrom relative to aircraft approaching said airstrip.

2. The apparatus as set forth in claim 1 wherein said means for discharging fire suppressant from said tubing includes a concentration nozzle pivotally mounted about said tubing in communication therewith for receiving fire suppressant therein and discharging said fire suppressant from said nozzle in a select high velocity stream.

3. The apparatus as set forth in claim 2 wherein said nozzle includes drive means for moving said nozzle bidirectionally about its axis in a rotational mode and angularly about a generally horizontally axis for controlling the horizontal distance said fire suppressant is discharged.

4. The apparatus as set forth in claim 3 wherein said nozzle further includes a heat sensor coupled thereto said coupled to said drive means for controlling the angulation said orientation of said nozzle relative to a point of combustion detected by said heat sensor.

5. The apparatus as set forth in claim 1 wherein said control system further includes a vapor evacuation network including a tubular array disposed adjacent said fire suppressant tubular array having a plurality of intake ports coupled thereto for selectively inhaling toxic fumes produced by combustion occurring in the vicinity of said system.

6. The apparatus as set forth in claim 5 wherein said vapor exhaust system includes a blower network constructed within said tubular array for creating a draft therein and lowering the pressure within said ports to infuse toxic vapor into said exhaust network.

7. A method of combatting a fire in the vicinity of an airport runway comprising steps of:

providing a system of pressurized tubing having fire suppressant received therein and constructed for maintaining a pressurized flow therethrough;

providing a plurality of discharge nozzles about said system for discharging fire suppressant on an area of combustion in the vicinity of said runway;

sensing the approach of an aircraft to the subject runway;

detecting the deviation of the aircraft from a predefined glide pattern adjacent to said runway;

activating said fire suppressant system in response to the detection of said aircraft deviating from said preselected flight pattern;

sensing combustion on and about said aircraft and said aircraft runway;

orienting said nozzle of said system of pressurized tubing in a direction toward said combustion; p1 pumping fire suppressant through said nozzles onto said combustion; and controlling the emission and discharge pattern of fire suppressant from said nozzles onto said combustion.

8. The method as set forth in claim 7 wherein said nozzles include means for directing the angulation thereof toward said combustion.

9. The method as set forth in claim 7 and including the step of providing an exhaust system adjacent said fire suppressant system; and activating said exhaust system subsequent to suppressing said combustion to remove toxic fumes produced by said combustion.

10. The method as set forth in claim 9 and further including the step of providing a control system interconnecting said exhaust system and said fire suppressant array nozzles for activating said nozzles and said exhaust system in response to the event of combustion upon said runway.

11. The method as set forth in claim 7 and further including a step of providing a pressure reservoir in conjunction with said fire suppressant system; and communicating said pressure reservoir with said fire suppressant to pressurize said fire suppressant array for the immediate discharge of fire suppressant within said array upon said combustion.

12. The method as set forth in claim 7 wherein said system further includes directional sensors constructed in conjunction with said fire suppressant nozzles for orienting said nozzles in the direction of combustion.

* * * * *